US005134262A

United States Patent [19]

Lee

[11] Patent Number: 5,134,262

[45] Date of Patent: Jul. 28, 1992

[54] FUNCTION CONTROL UNIT WITH TIMER FOR MICROWAVE OVEN

[75] Inventor: Gi I. Lee, ChangWon City, Rep. of Korea

[73] Assignee: Goldstar Co., Ltd., Rep. of Korea

[21] Appl. No.: 527,034

[22] Filed: May 22, 1990

[30] Foreign Application Priority Data

May 31, 1989 [KR] Rep. of Korea ..... 7286/1989

[51] Int. Cl.[5] ..... H05B 6/68

[52] U.S. Cl. ..... 219/10.55 B; 219/10.55 E; 200/38 FA; 99/325

[58] Field of Search ..... 219/10.55 B, 10.55 R, 219/10.55 E; 200/38 R, 38 A, 38 FA; 99/325

[56] References Cited

U.S. PATENT DOCUMENTS 4,100,381 7/1978 Marquis ..... 200/38 A
4,177,370 12/1979 Otani ..... 219/10.55 B
4,242,547 12/1980 Hashimoto ..... 200/38 R
4,255,627 3/1981 Marquis ..... 200/38 R
4,600,826 7/1986 Ishimura ..... 219/10.55 B
4,675,478 6/1987 Song ..... 200/38 R
4,678,930 7/1987 Mahon ..... 200/38 R

*Primary Examiner*—Philip H. Leung
*Attorney, Agent, or Firm*—Anthony J. Casella; Gerald E. Hespos

[57] ABSTRACT

A defrosting unit with a timer, wherein the unit includes a round drum shaped wheel 5 for cooking function, a lobed wheel 6 for defrosting having a peripheral shape so as to produce periodic on/off contacts in cycles with a switch 8, both wheels being mounted on the shaft 2 of the timer 1 and on the shaft 4 of the knob 7, a joint 3 joining the knob shaft with the timer shaft in such a way as to move the shafts in a back and forth movement for a distance (S) of stroke, and the sensitive switch 8 operating on/off in association with the wheels moved with shafts.

3 Claims, 4 Drawing Sheets

FUNCTION CONTROL UNIT WITH TIMER FOR MICROWAVE OVEN

BACKGROUND OF THE INVENTION

The present invention relates to a defrosting unit for a microwave oven, and more particularly to a defrosting unit equipped with a timer for selecting a cooking function or a defrosting function by simply manipulating a timer knob on the microwave oven having both the functions.

In the conventional art, a power selection switch, as shown in FIG. 1 (*a*), for cooking operation and a defrosting device, as shown in FIG. 1 (*b*), are separately provided in the microwave oven. The power selection switch for cooking comprises a sensitive switch 1, a cam 2 for on/off operation of the contact 1' of the switch 1, a plate spring 3 resiliently supporting the cam 2, and a main body 5, 5' supporting the spring 3 and a shaft, the external end of which mounting a knob 7 for turning in the directions of arrows 6 and 6'. On the other hand, the defrosting device in FIG. 1 (*b*) comprises a synchronous motor 8, a gear 10 mounted on the shaft 9 of the motor 8, a gear B11 engaging with the gear 10, a cam 12 for defrosting function and being mounted on a rotatory shaft 13, and a sensitive switch 14 for defrosting function and being mounted on a side of the cam 12.

For defrosting operation with the above construction, the knob 7 is turned in the direction of the arrow 6' for the cam 2 mounted in common with the knob 7 on a shaft 4 to follow in turn in the same direction 6'and turn off the contact 1' of the switch 1, as shown in FIG. 1 (*a*). On the other hand, the synchronous motor 8, with power on, rotates at a speed to turn the gear A10 mounted on the motor shaft 9 so as to drive the gear B11 in engagement with the gear A10 and in following rotate the cam 12 on the common shaft 13.

Consequently, the sensitive switch 14 comes to operate on/off in cycles of a period under the arcuate action of the cam 12 for defrosting operation.

Thus, for a defrosting operation, the switch 1 for cooking function is turned off while the switch 14 for defrosting function operates on/off in cycles.

For cooking operation, the knob 7 in the power selection switch in FIG. 1 (*a*) is turned in the direction of the arrow 6 contrary to the direction for the defrosting function so as to make the cam 2 follow in rotation in the same direction to turn on the contact 1' of the switch 1 for cooking, while the defrosting operation.

However, since the switch 1 is on for cooking function, the cooking operation of food proceeds irrelevant to the on/off operation of the switch 14 for defrosting.

In the above conventional construction having separate devices respectively for cooking and defrosting operations, a disadvantage is that the construction technically is complicated to result in a high manufacturing cost with a problem of difficulty in assembling.

SUMMARY OF THE INVENTION

The present invention is designed to eliminate the disadvantage of the conventional art, and the invention incorporates the separate devices respectively for cooking and defrosting into an integral body for simple manipulation and operation of the microwave oven.

FIG. (*b*) shows a perspective view of a conventional defrosting device;

FIG. (*c*) shows a front view of a conventional control panel.

Figure 1A:
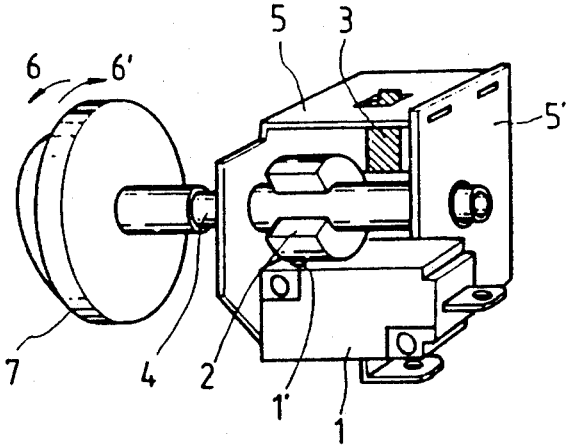
FIG. 1(A) (PRIOR ART)
FIG. 1 (*a*) shows a perspective view of a conventional power selection switch.
Figure 1B:
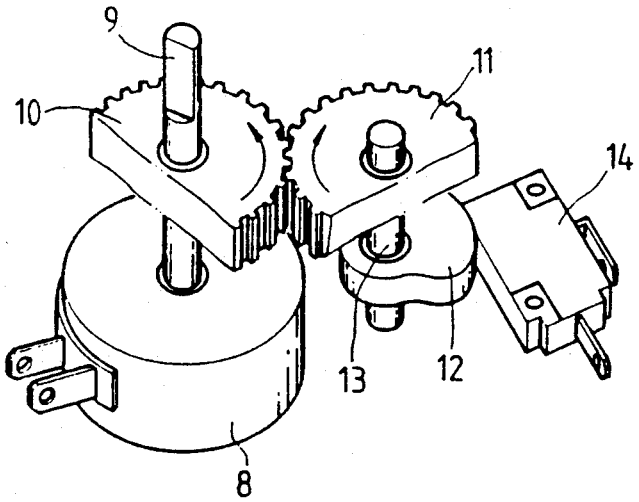
FIG. 1(B) (PRIOR ART)
Figure 1C:
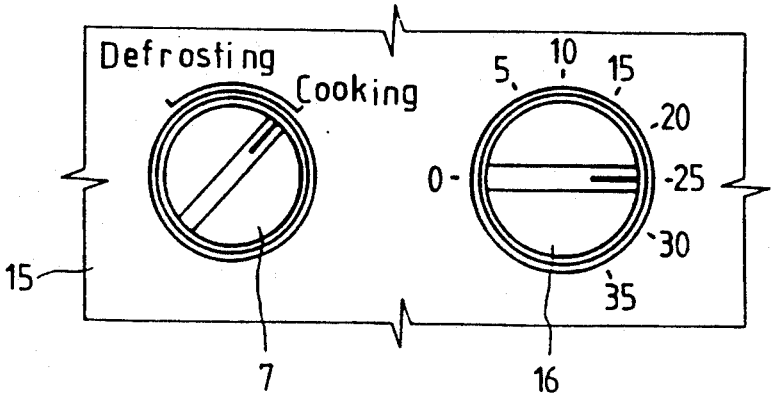
FIG. 1(C) (PRIOR ART)
Figure 2:
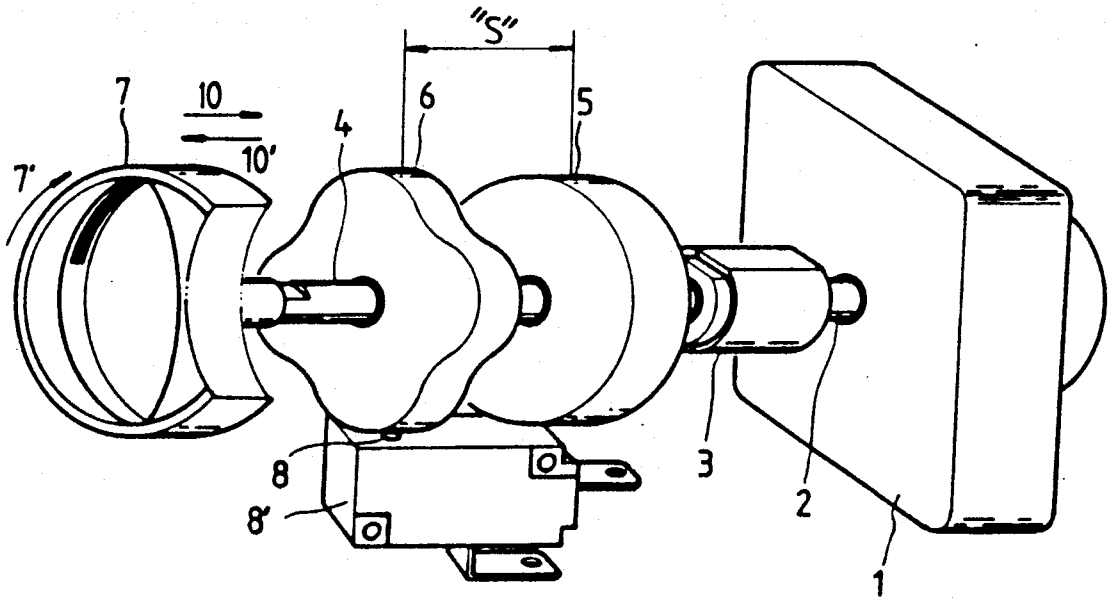

FIG. 2 shows a perspective view of an embodiment employing a timer according to the invention.

Figures 3A, 3B:
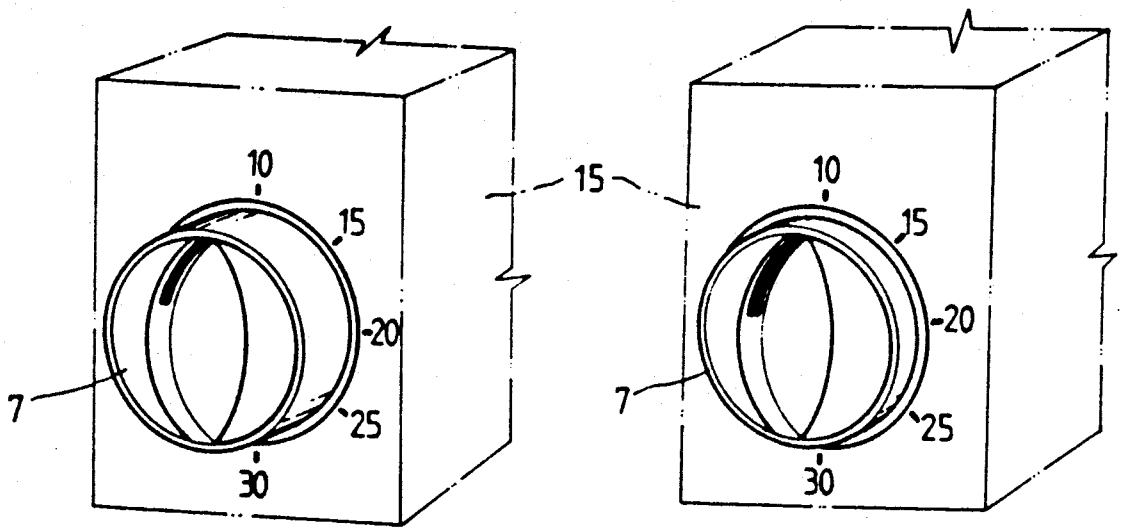

FIGS. 3 (*a*) and (*b*) show the positions of the knob for cooking and defrosting in the device of the invention.

Figure 4B:
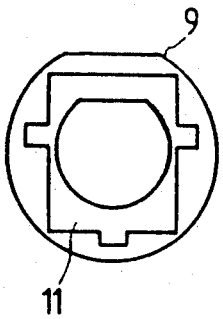
Figure 4A:
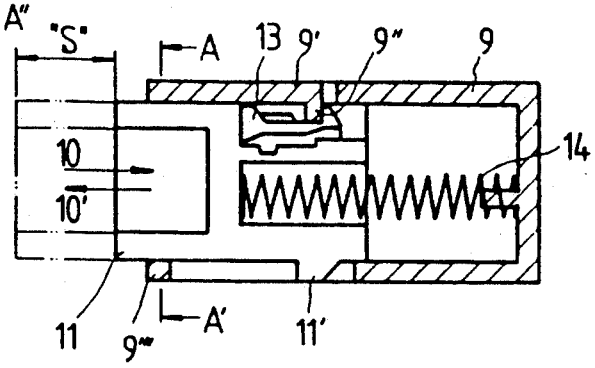

FIG. 4 (*a*) shows a sectional view of a joint for defrosting according to the invention;

FIG. (*b*) shows sectional view along the line A—A in FIG. 4 (*a*)

Figure 5:
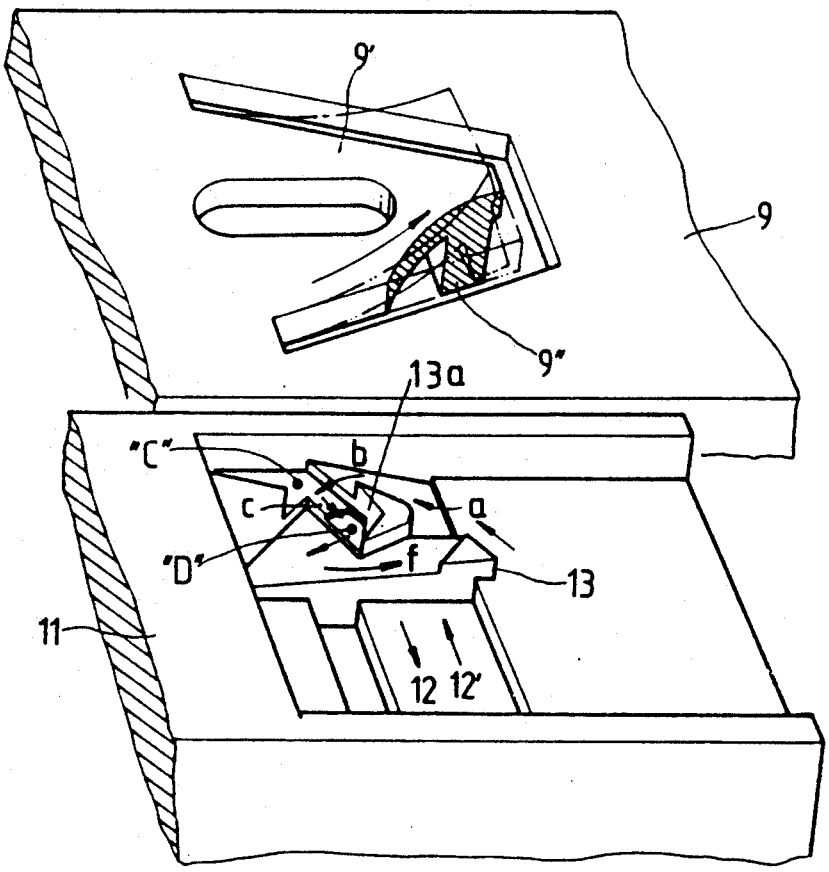

FIG. 5 shows an exploded perspective view of a joint guide and a guide plate for an outer casing.

Numerals in the drawings indicate the following: Numeral 1 indicating a timer, 2 a timer shaft, 3 a joint, 4 a knob shaft, 5 a lobed wheel for cooking, 6 a lobed wheel for defrosting, 7 a knob, 8 a sensitive switch, S a stroke distance.

DETAILED DESCRIPTION OF THE INVENTION

The invention shall be described in details with reference to the drawings. In FIG. 2, a timer 1 has a shaft 2 mounting a joint 3 on it, the joint 3 having a knob shaft 4 at an end. The shaft 4 mounts to it a wheel 5 for cooking function and another lobed wheel 6 for defrosting disposed in the mid-section of the shaft and also mounts a knob 7 at its end.

The wheels 5 and 6 respectively for cooking and defrosting are arranged for the wheel periphery or lobe tips to make contacts with the sensitive switch 8 for combined cooking and defrosting functions.

In the construction of a joint 3 shown in FIGS. 4 and 5, within an outer casing 9 there are provided a reciprocating member 11 for reciprocating movements in the directions 10 and 10', a guide member 13 for movements in the vertical arrow directions 12 and 12' within the member 11, a guide plate 9' resiliently mounted on the top side of the outer casing 9 and designating any of the directions 12 and 12' for the guide member 13, and a stopper 9'' protruding toward the guide member 13. There is also provided a resilient spring 14 for assisting the reciprocating member 11 in movements in the arrow directions 10 and 10' within the casing 9. On the top of the guide member 13 there is formed in the center of (c) a recess 13*a* for controlling the stopper 9'', having stepped face portions (b) for advance, (c) for catching and (f) for discharge.

According to the above construction of the invention, a push to the knob 7 as shown in FIG. 3(*a*) results in the selection of cooking function, and another push to the knob makes it to pop out for selection of defrosting function. With defrosting function selected, a turn of the knob 7 in the direction of an arrow 7' sets the timer 1 via shaft 7, joint 3 and timer shaft 2 at a time required for defrosting the selected food as in a cook book.

Whereas, the contact 8' of the switch 8 comes to be on/off in contact with the lobe top of the wheel 6 for defrosting the food in cycles of a peirod according to the lobe formations on the periphery of the wheel 6.

Variations in the shape and number of lobes of the wheel may suitably adjust the defrosting time of food, as desired. To select a cooking function after defrosting a food, the knob 7 is once more gently pushed and then released for it to pop out along with the shaft 4, the lobed wheels 5 and 6 in the direction 10' by the action of the joint 3 and thus make the round peripheral face of the wheel 5 to be in steady contact with the contact 8' of the switch 8 for the cooking operation.

In switching from the defrosting function to a cooking function, the joint 3 for controlling the back and forth movements of the knob shaft moves in the direction 10 the reciprocating member 11 positioned on line "A", as shown in FIG. 4(*a*) and FIG. 5, for the guide member 13 to move in the direction 12' by the actions of the stopper 9'' of the guide plate 9 and of the slope of the face portion (a) for advance and place the stopper 9'' at "C" point of the guide member 13. Thereupon, removing the pushing pressure the stopper 9'' stops at "D" point of the guide member 13 by the resilient force of the spring 14 and by the action of the inclined faces of stopper 9'' and the portion (c). The state of stoppage indicates the position of the joint 3 for defrosting function, with the knob 7 not popping out from the ontrol panel 5.

Thereafter, for switching from the defrosting function to a cooking operation, the knob 7 is once more pushed for advancing the guide member 13 for the catch face (c) to be unhooked from the stopper 9'' and for the discharge face (d) to come under the stopper 9'' for unhooking the member 13 from it. Thereupon, removing the pushing pressure, the knob 7 returns to the original position by the resilient force of the spring 14 for the projective hook of the reciprocating member 11' to be stopped by a stopper 9'' of the outer casing 9.

Thus, the cooking and defrosting functions of a microwave oven may be selected and executed by moving the knob shaft for the distance "S" of a stroke to make either of the wheels 5 and 6 contact for connection with the sensitive switch 8 in alternation.

As stated above, the present invention sets an accurate time for defrosting the food by mounting a defrosting wheel on the same shaft as for the timer, and may adjust the defrosting time set for the oven by changing the peripheral shape of the wheel for defrosting function. Further, the integral construction for combined cooking and defrosting function facilitates manufacture and manipulation of the microwave oven with a consequent reductin of the manufacturing cost and saves more space for other uses to an advantage.

What is claimed is:

1. A function control unit with a timer in a microwave oven, comprising:

a knob for selecting a time for performing one of a defrosting function and a cooking function;

a shaft having opposed first and second ends, the first end of said shaft being fixed to said knob;

a joint having an axially reciprocating member, said joint being fixed to the second end of said shaft for axially reciprocating said shaft from a first axial position corresponding to the cooking function to a second axial position corresponding to the defrosting function;

a round drum shaped wheel coaxially assembled in unison with said shaft at a first axial location thereon for being simultaneously rotated with said shaft;

a lobed wheel assembled in unison with said shaft at a second axial location thereon for being simultaneously rotated with said shaft, said lobed wheel having a non-round peripheral surface;

a switch for selectively turning the microwave oven on mounted proximate to said shaft for being contacted by said round drum shaped wheel when said shaft is in said first axial position and for being contacted by said peripheral surface of said lobed wheel when said first shaft is in said second axial position; and a timer fixed to the joint for rotating the joint and the shaft during the time selected with said knob, whereby the rotation of the shaft causes the round drum shaped wheel to contact the switch for performing a cooking function in the first axial position of the shaft and alternatively causing the lobed wheel to contact the switch for performing a defrosting function in the second axial position of the shaft.

2. A function control unit with a timer according to claim 1, wherein the spacing between said round drum shaped wheel and said lobed wheel is the same as the distance of the axial reciprocating movement of said joint.

3. A function control unit with a timer according to claim 1, wherein a plurality of lobes are shaped on the peripheral surface of said lobed wheel for contacting said switch periodically.

* * * * *